US009069324B2

(12) United States Patent
Mori

(10) Patent No.: US 9,069,324 B2
(45) Date of Patent: Jun. 30, 2015

(54) IMAGE FORMING APPARATUS

(71) Applicant: Shogo Mori, Nagoya (JP)

(72) Inventor: Shogo Mori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/011,372

(22) Filed: Aug. 27, 2013

(65) Prior Publication Data

US 2014/0056612 A1 Feb. 27, 2014

(30) Foreign Application Priority Data

Aug. 27, 2012 (JP) ..... 2012-186939

(51) Int. Cl.
*G03G 21/16* (2006.01)

(52) U.S. Cl.
CPC ..... *G03G 21/1633* (2013.01)

(58) Field of Classification Search
CPC G03G 15/60; G03G 21/1633; G03G 21/1652
USPC ..... 399/90, 107, 110, 114, 177, 219, 220
See application file for complete search history.

(56) References Cited

U.S. PATENT DOCUMENTS

| | | | | |
|---|---|---|---|---|
| 8,126,356 | B2 | 2/2012 | Watanabe et al. | |
| 2009/0169249 | A1* | 7/2009 | Watanabe et al. | 399/114 |
| 2010/0238259 | A1* | 9/2010 | Naruse | 347/224 |
| 2011/0037823 | A1* | 2/2011 | Yokoi et al. | 347/237 |
| 2012/0183320 | A1* | 7/2012 | Sato et al. | 399/110 |
| 2013/0259521 | A1* | 10/2013 | Sugiyama | 399/110 |

FOREIGN PATENT DOCUMENTS

| | | | |
|---|---|---|---|
| JP | 2007-065125 | A | 3/2007 |
| JP | 2009-157137 | A | 7/2009 |
| JP | 2010-019117 | A | 1/2010 |
| JP | 2010-164614 | A | 7/2010 |
| JP | 2011-000780 | A | 1/2011 |
| JP | 2012-088480 | A | 5/2012 |

* cited by examiner

*Primary Examiner* — Francis Gray
(74) *Attorney, Agent, or Firm* — Banner & Witcoff, Ltd.

(57) ABSTRACT

An image forming apparatus including: a body frame including an opening; a cover configured to rotate between an open position where the cover opens the opening and a closed position where the cover closes the opening and including a base end portion rotatably supported by the body frame and a distal end portion; an exposure member supported by the cover and configured to swing when the cover is rotated from the closed position to the open position; a cable configured to transmit current to the exposure member; and a metal plate fixed to the cover and having a through-hole through which the cable extends, the metal plate including, a main body part, and a conduction part protruding, toward the exposure member, from the main body part adjacent to the through-hole at the distal end side of the cover.

20 Claims, 9 Drawing Sheets

IMAGE FORMING APPARATUS

CROSS-REFERENCE TO RELATED APPLICATIONS

This application claims priority from Japanese Patent Application No. 2012-186939 filed on Aug. 27, 2012, the entire contents of which are incorporated herein by reference.

TECHNICAL FIELD

Aspects of the invention relate to an image forming apparatus having an exposure member that is swingably supported by a cover.

BACKGROUND

An image forming apparatus, which has a top cover rotatably provided to an upper part of a body frame and an exposure member supported by the top cover to be hung from the top cover and swingable relative to the top cover, has been known.

In the above-described image forming apparatus, a cable for transmitting current to the exposure member is arranged from a control substrate to a gap between an upper wall and a lower wall disposed below the upper wall, and is connected to the exposure member through an opening formed at the lower wall. However, in this structure, a gap between an upper end of the exposure member and the lower wall at a state where the top cover is closed is increased when the top cover is opened, and the cable may be exposed to a distal end side (user side) of the top cover through the increased gap.

In this case, when a user brings a finger close to the cable, static electricity is transferred from the finger to the cable, so that the control substrate and the like may be negatively affected.

SUMMARY

Accordingly, an object of the invention is to suppress static electricity from being transferred from a user's finger to a cable when opening a cover.

According to an aspect of the invention, there is provided an image forming apparatus including: a body frame including an opening; a cover configured to rotate between an open position where the cover opens the opening and a closed position where the cover closes the opening and including a base end portion rotatably supported by the body frame, and further including a distal end portion opposite to the base end portion; an exposure member including a light source, supported by the cover and configured to swing relative to the cover when the cover is rotated from the closed position to the open position; a cable configured to transmit current to the exposure member; a metal plate fixed to the cover and having a through-hole through which the cable extends, the metal plate including, a main body part, and a conduction part protruding, toward the exposure member, from the main body part adjacent to the through-hole at the distal end side of the cover.

According to another aspect of the invention, there is provided an image forming apparatus including: a body frame including an opening; a cover configured to move between an open position where the cover opens the opening and a closed position where the cover closes the opening, the cover including a first end portion supported by the body frame and a second end portion opposite to the first end portion; an exposure member including a first end portion supported by the cover and a second end portion opposite to the first end portion of the exposure member, a distance between the second end portion of the exposure member and the cover being larger when the cover is in the closed position than when the cover is in the open position; a metal plate supported by the cover and including a through-hole having a first end portion and a second end portion, a distance between the first end portion of the through-hole and the first end portion of the cover being smaller than a distance between the second end portion of the through-hole and the first end portion of the cover; a cable passing through the through hole and configured to transmit current to the exposure member; and a conduction part provided to the metal plate at the second end portion of the through-hole and extending towards the exposure member side.

According to the invention, it is possible to suppress static electricity from being transferred from a user's finger to the cable when opening the cover.

DETAILED DESCRIPTION

Hereinafter, an illustrative embodiment of the invention will be specifically described with reference to the drawings. Meanwhile, in the following descriptions, a schematic configuration of a color printer 1, which is an example of the image forming apparatus, will be first briefly described and a characteristic configuration of the invention will be then specifically described.

In the following descriptions, a direction is described based on a user who uses the color printer 1. That is, the right side in FIG. 1 is referred to as the 'front side', the left side is referred to as the 'rear side', the front side is referred to as the 'left side' and the inner side is referred to as the 'right side.' Also, the upper and lower directions in FIG. 1 are referred to as the 'upper-lower direction.'

<Schematic Configuration of Color Printer>

Figure 1:
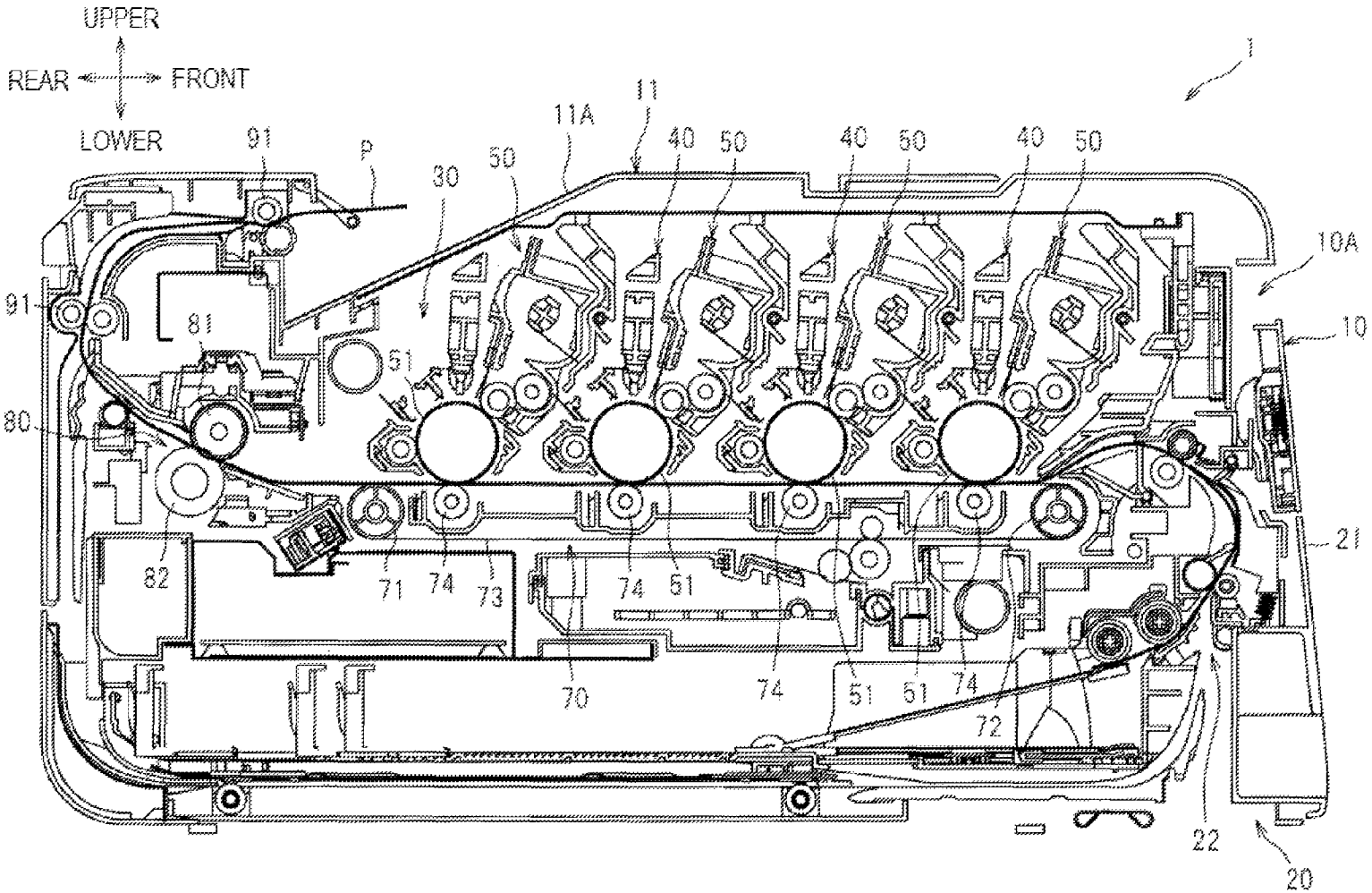
FIG. 1 is a sectional view showing a color printer according to an illustrative embodiment of the invention.

As shown in FIG. 1, the color printer 1 mainly has a body frame 10, a top cover 11 which is an example of the cover, and a feeder unit 2 and an image forming unit 30 which are provided in the body frame 10.

The top cover 11 is arranged at an upper part of the body frame 10 and a rear end portion (base end portion) thereof is rotatably supported to the body frame 10 so as to open and close an opening 10A formed at the upper part of the body frame 10. Specifically, the top cover 11 is configured to swing between a close position (refer to FIG. 1) at which the opening 10A is closed and an open position (refer to FIG. 2) at which the opening 10A is opened.

The feeder unit 20 is provided at the lower portion in the body frame 10 and mainly has a sheet feeding tray 21 that accommodates therein sheets P and a sheet feeding mechanism 22 that feeds the sheets P from the sheet feeding tray 21 to the image forming unit 30. The sheets P in the sheet feeding tray 21 are separated and fed one by one to the image forming unit 30 by the sheet feeding mechanism 22.

The image forming unit 30 mainly has four LED units 40 which are examples of a plurality of exposure members, four process cartridges 50, a transfer unit 70 and a fixing unit 80.

The respective LED units 40 are arranged side by side in a front-rear direction (a direction from a distal end portion of the top cover 11 towards a base end portion of the top cover 11). The LED unit 40 has a plurality of LEDs at the distal end thereof and is swingably supported to the top cover 11 to be hung from the top cover 11.

The plurality of LEDs blinks based on image data, so that the LED unit 40 exposes a surface of a photosensitive drum 51.

The respective process cartridges 50 are arranged side by side in the front-rear direction between the top cover 11 and the sheet feeding tray 21. Each process cartridge 50 is detachably mounted to the body frame 10 through the opening 10A of the body frame 10 at a state where the top cover 11 is opened (refer to FIG. 2). Also, each process cartridge 50 mainly has the photosensitive drum 51, a charger, a developing roller, a toner accommodation chamber and the like, which are well known and for which reference numerals are omitted.

The transfer unit 70 is provided between the sheet feeding tray 21 and the process cartridges 50 and mainly has a driving roller 71, a driven roller 72, an endless conveyance belt 73 that is provided in a tensioned state between the driving roller 71 and the driven roller 72 and four transfer rollers 74. The conveyance belt 73 has an outer surface that abuts on the respective photosensitive drums 51, and the respective transfer rollers 74 are arranged to sandwich the conveyance belt 73 at an inside of the belt between the transfer rollers and the photosensitive drums 51.

The fixing unit 80 is provided at the rear side of the process cartridges 50 and the transfer unit 70 and mainly has a heating roller 81 and a pressing roller 82 that is arranged to face the heating roller 81 and press the heating roller 81.

In the image forming unit 30, the surfaces of the photosensitive drums 51 are uniformly charged by the chargers and then exposed by the LED units 40, so that electrostatic latent images based on image data are formed on the photosensitive drums 51. Then, toner is supplied from the developing rollers to the photosensitive drums 51, so that the electrostatic latent images become visible and toner images are thus formed on the photosensitive drums 51.

As the sheet P that is fed from the feeder unit 20 is conveyed between the photosensitive drums 51 and the conveyance belt 73 (transfer rollers 74), the toner images formed on the respective photosensitive drums 51 are sequentially transferred while being overlapped onto the sheet P. The sheet P having the toner images transferred thereto is conveyed between the heating roller 81 and the pressing roller 82, so that the toner images are heat-fixed. After that, the sheet P is discharged to the outside from the body frame 10 by conveyance rollers 91 and is put on a discharge tray 11A formed on an upper surface of the top cover 11.

<Structure Around LED Unit>

Subsequently, a structure around the LED unit 40 will be specifically described.

Figure 3:
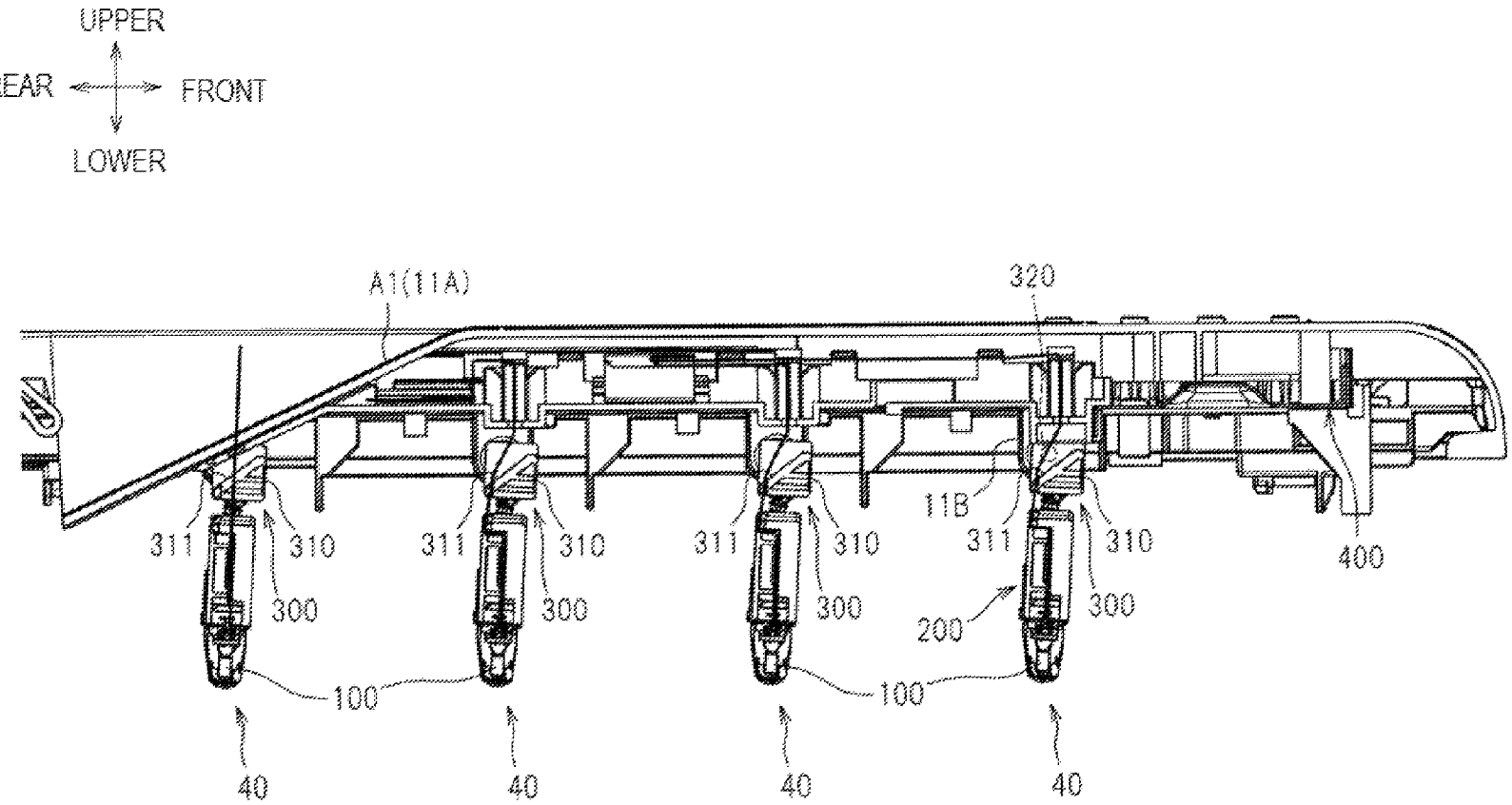
FIG. 3 is a sectional view showing a structure around an LED unit.
Figure 4:
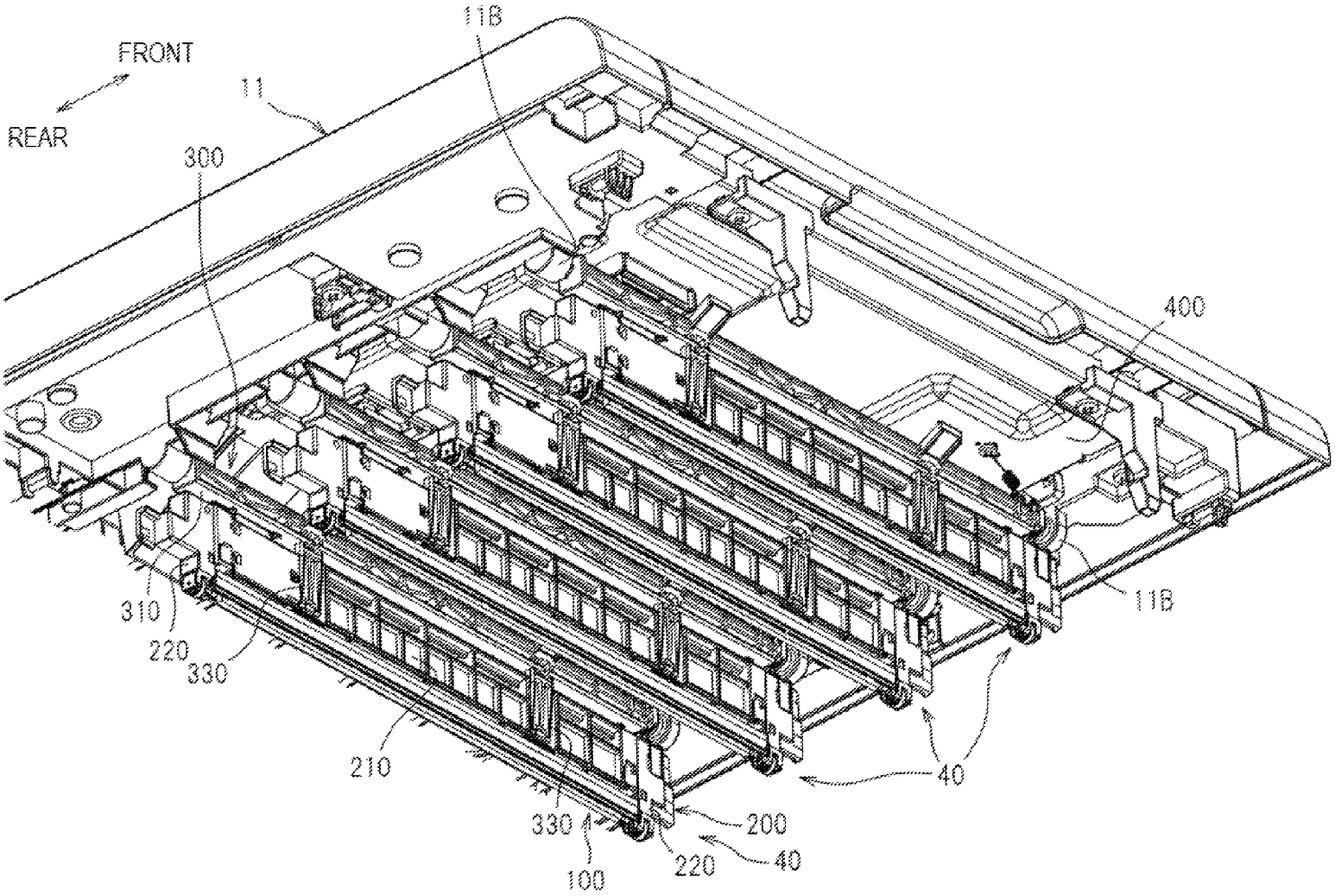
FIG. 4 is a perspective view of the top cover, which is obliquely seen from the lower side.

As shown in FIGS. 3 and 4, the LED unit 40 has an LED head 100, a resin support frame 200 that supports the LED head 100 and a resin holder 300 that supports the support frame 200.

The LED head 100 is a long member extending in a left-right direction and has a plurality of LED arrays having a plurality of LEDs that is arranged in a line in the left-right direction on a semiconductor chip and a lens array that is arranged below the plurality of LED arrays.

The support frame 200 is arranged at an upper side of the LED unit 40 and mainly has a long base part 210 extending in the left-right direction and a pair of extension parts 220 extending downwards from both end portions of the base part 210 in the left-right direction (longitudinal direction). The LED unit 40 is supported by the support frame 200 while being arranged between the pair of extension parts 220.

The holder 300 is arranged at an upper side of the support frame 200 and mainly has a long main body part 310 extending in the left-right direction, rotary shafts 320 extending outwards from both left and right end portions of the main body part 310 in the left-right direction, and holding arms 330 extending downwards from inner parts of the left and right rotary shafts 320 in the left-right direction and supporting the base part 210 of the support frame 200 by sandwiched the base part 210 in the front-rear direction.

The left and right rotary shaft 320 are rotatably supported by holder support members 11B that are provided to left and right end portions of the top cover 11. Thereby, the LED unit 40 is adapted to swing relative to the top cover 11.

The LED unit 40 is adapted to swing in conjunction with an opening/closing operation of the top cover 11 by a well-known interlocking mechanism. Specifically, when the top cover 11 is closed, the LED unit 40 is arranged at an exposure position (refer to FIG. 1) at which the photosensitive drum 51 can be exposed. When the top cover 11 is rotated from the closed position to an open position, a lower end portion (distal end portion) of the LED unit 40 swings to come close to the base end portion of the top cover 11, so that the LED unit 40 is arranged at a retreat position (refer to FIG. 2) at which the LED unit 40 is more folded towards the top cover 11 than at the exposure position.

The most rearward LED unit 40 of the four LED units 40 is arranged below an inclined bottom surface A1 of the discharge tray 11A. The main body part 310 (base end portion) of the most rearward LED unit 40 has an inclined surface 311 that is opposed to the inclined bottom surface A1 when the top cover 11 is at the closed position.

Thereby, it is possible to bring the main body part 310 of the LED unit 40 close to the bottom surface A1 of the discharge tray 11A, so that it is possible to reduce the size of the color printer 1 in the upper-lower direction. In the meantime, the three main body parts 310 at the front side also have a configuration having the same inclined surfaces 311 as that of the most rearward main body part 310, i.e., have a triangular shape in a sectional view, so as to realize communization of parts.

Figure 5:
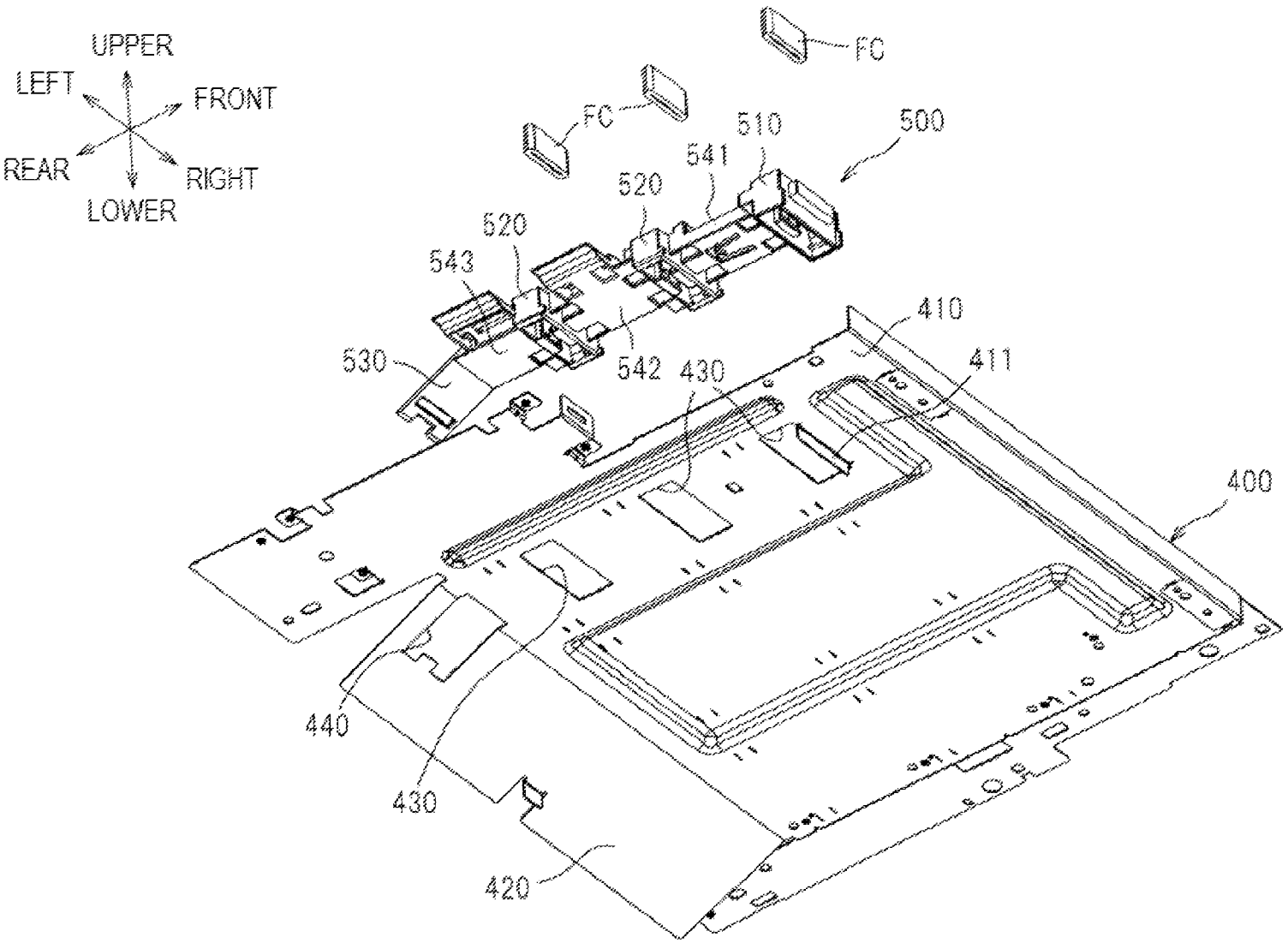
FIG. 5 is an exploded perspective view of a metal plate, a core holding member and a ferrite core at a disassembled state, which are obliquely seen from the lower side.
Figure 6:
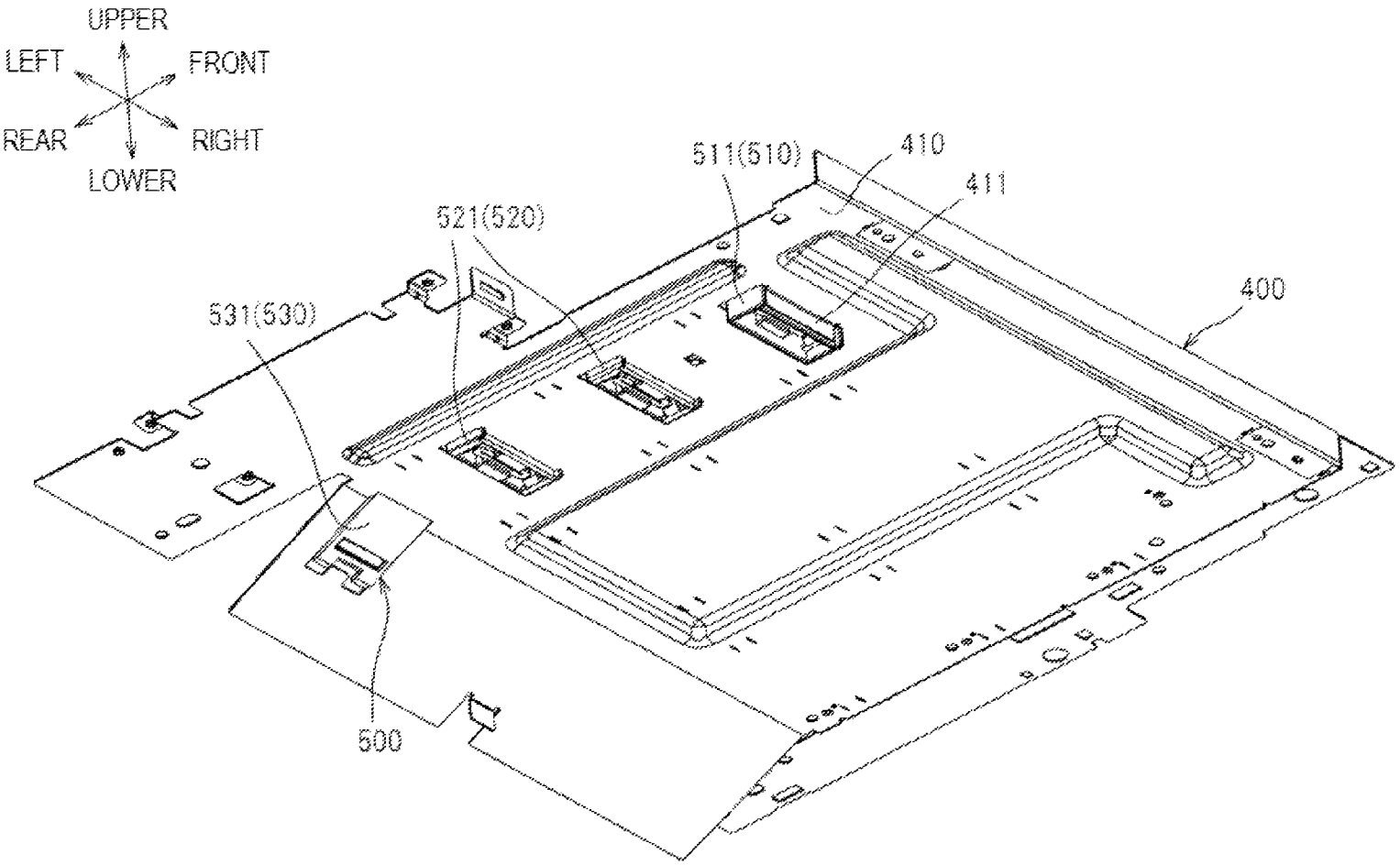
FIG. 6 is a perspective view of the metal plate, the core holding member and the ferrite core at an assembled state, which are obliquely seen from the lower side.
Figure 7:
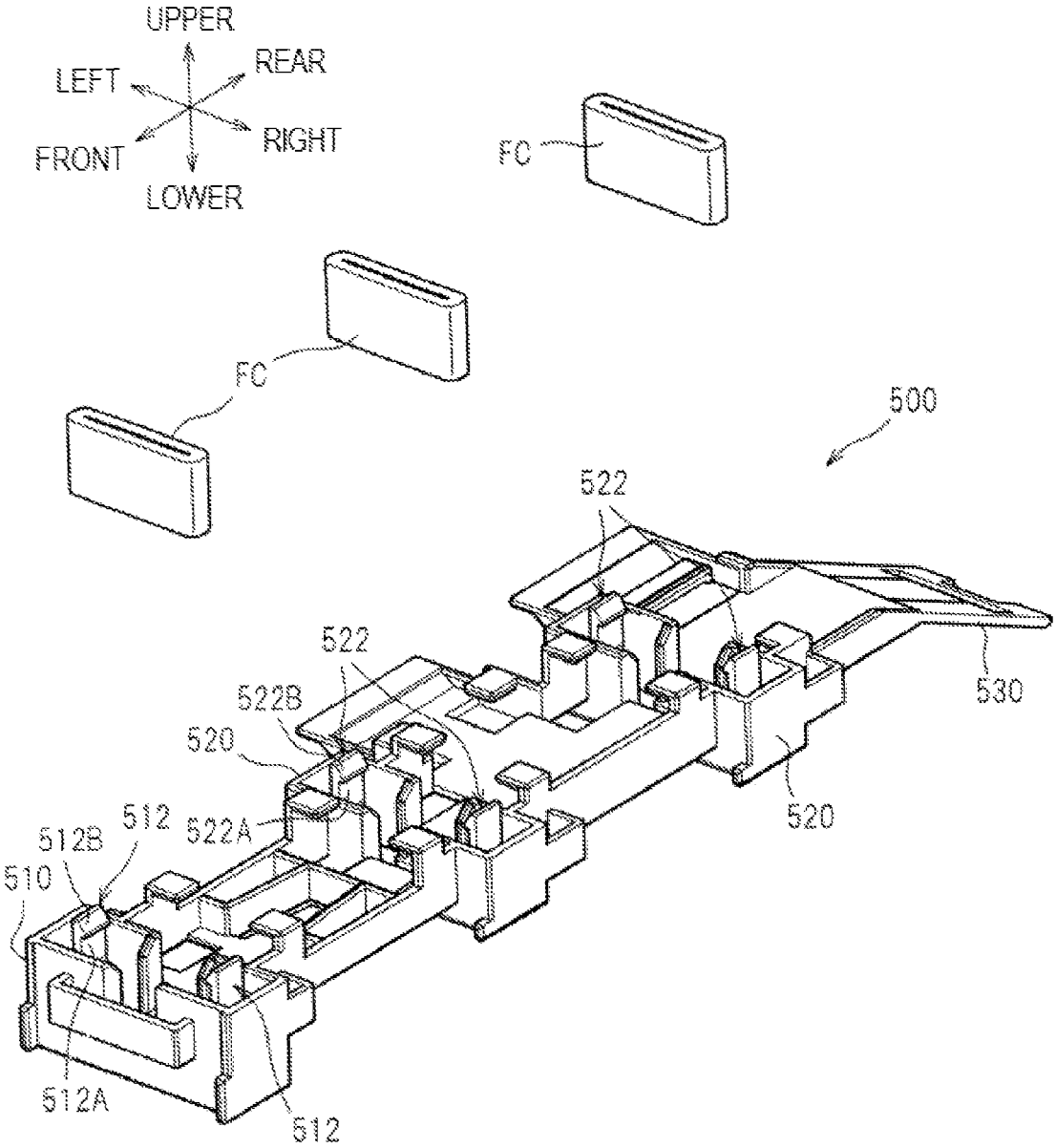
FIG. 7 is an exploded perspective view of the core holding member and the ferrite cores at a disassembled state, which are obliquely seen from the upper side.

A metal plate 400 that is fixed to the top cover 11 is provided above the LED units 40. As shown in FIGS. 5 to 7, the metal plate 400 has a substantially rectangular main body part 410 that is substantially perpendicular to a surface in the upper-lower direction and an inclined part 420 that obliquely extends rearwards and downwards from a rear end of the main body part 410.

A left side of the metal plate 400 is formed with four through-holes 430, 440, through which flat cables C for transmitting current to the LED units 40 pass from the top cover 11-side towards the LED units 40 side, side by side at an interval in the front-rear direction. Specifically, each of the three through-holes 430 of the front side is a rectangular hole extending in the left-right direction and is formed at the main body part 410.

The most rearward through-hole 440 is a substantially rectangular hole extending in the front-rear direction and is formed over the main body part 410 and the inclined part 420. A front side (distal end portion side of the top cover 11) of the most forward through-hole 430 is provided at its end portion with a conduction part 411 protruding towards the lower side (the LED unit 40 side).

Figure 8A:
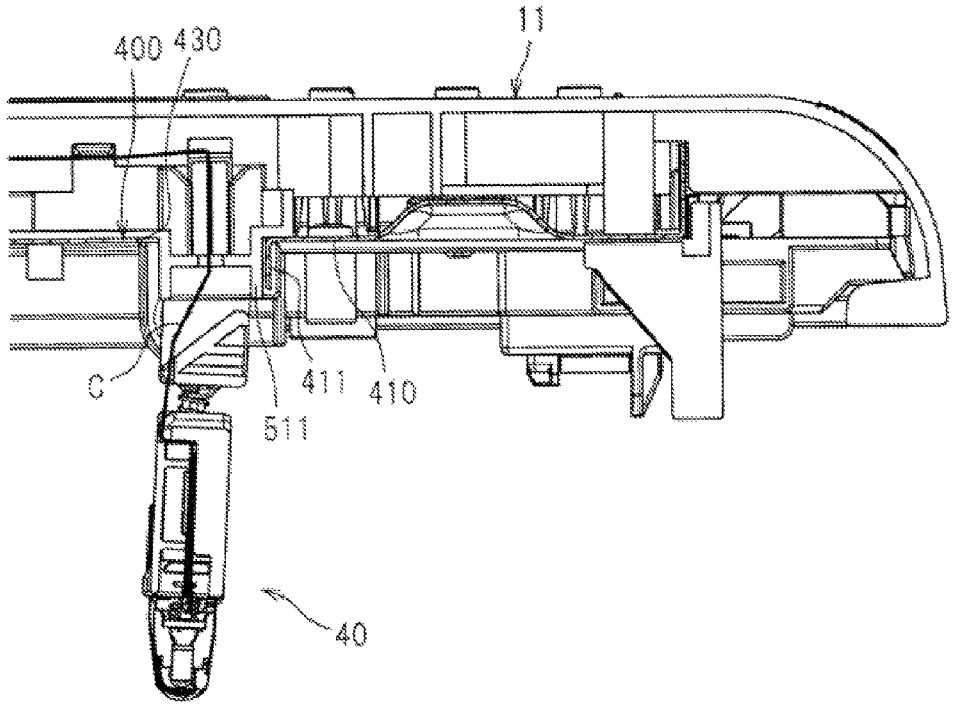
FIG. 8A is a sectional view showing a state of the LED unit when the top cover is closed and FIG. 8B is a sectional view showing a state of the LED unit when the top cover is opened.
Figure 8B:
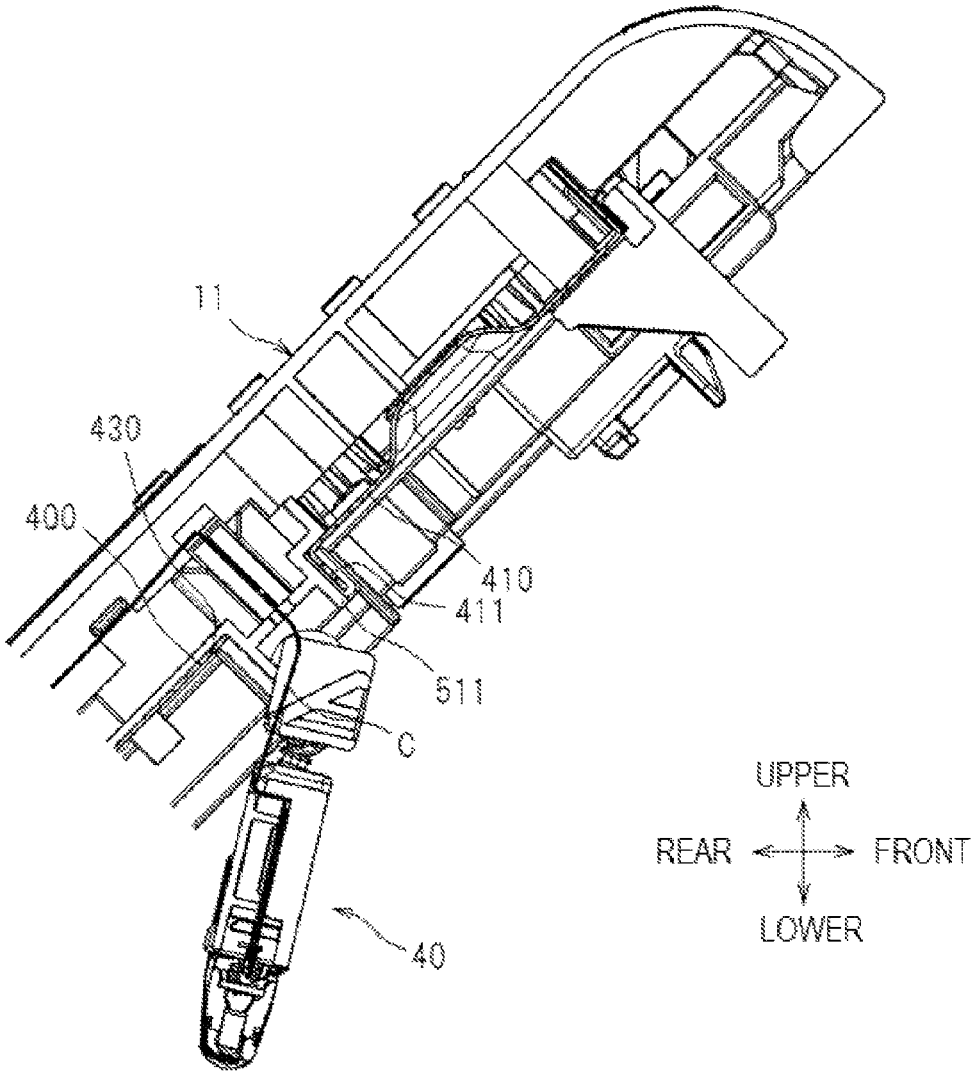

Thereby, as shown in FIGS. 8A and 8B, when the top cover 11 is opened, the LED unit 40 swings, so that a gap between the LED unit 40 and the metal plate 400 is increased. In this case, even if the flexible flat cable C is exposed to the front side (user side) through the gap, the conduction part 411, which is provided at the front side of the flexible flat cable C passing through the through-hole 430, can suppress static electricity from being transferred from a user's finger towards the flexible flat cable C.

The conduction part 411 is integrally formed with the metal plate 400 by cutting the metal plate 400. Thereby, it is possible to simplify a structure, compared to when the conduction part is separately formed from the metal plate, for example.

Also, in this illustrative embodiment, since the conduction part 411 is provided to only the most forward through-hole 430 of the four through-holes 430, 440, it is possible to reduce the weight of the metal plate 400, there by reducing the weight of the color printer 1, compared to when the conduction part is provided to all the through-holes.

Figure 2:
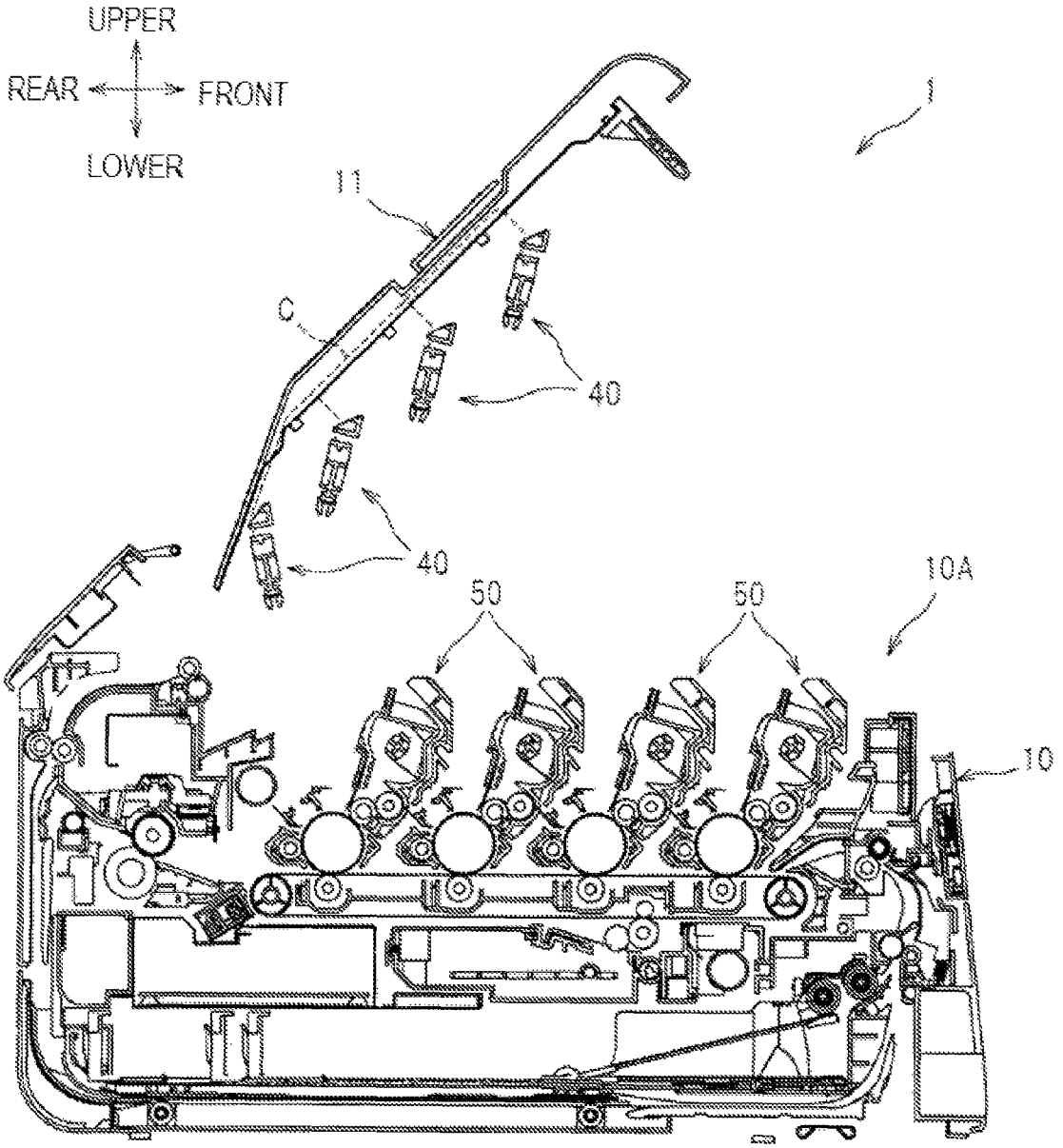
FIG. 2 is a sectional view showing a state where a top cover is opened.

In the meantime, as schematically shown with a broken line in FIG. 2, the respective flexible flat cables C connected to the three LED units 40 of the rear side are configured so that they are hidden by the respective LED units 40 arranged at the front side thereof (so that they overlap with the LED units 40 when seen from the front side), when the top cover 11 is opened. Thereby, since the user's finger is suppressed from coming close to the respective flexible flat cables C of the rear side by the respective LED units 40 of the front side, it is possible to suppress the static electricity from being transferred from the user's finger to the respective flexible flat cables C of the rear side.

Also, a resin core holding member 500 for holding ferrite cores FC, which are an example of the noise reduction member, is provided at an upper side of the four through-holes 430, 440. Here, the ferrite cores FC are tubular members and are provided to surround the flexible flat cables C so as to reduce noises that are generated from the three flexible flat cables C of the front side.

The core holding member 500 has four tubular parts 510, 520, 530, which are an example of the resin member, and connection parts 541, 542, 543 that connect the respective tubular parts 510, 520, 530. Each of the three tubular parts 510, 520 of the front side has a rectangular tube shape extending in the upper-lower direction and the most rearward tubular part 530 has a flat tube shape. The respective tubular parts are configured to be inserted into the respective through-holes 430, 440 of the metal plate 400 from the upper side.

Specifically, the respective tubular parts 510, 520, 530 have shapes coinciding with the corresponding through-holes 430, 440. The flexible flat cables C are inserted into the respective tubular parts 510, 520, 530.

Thereby, the respective tubular parts 510, 520, 530 can suppress the flexible flat cables C from contacting with the metal plate 400.

Also, as shown in FIG. 6, the respective tubular parts 510, 520, 530 are configured so that lower parts thereof are protrusion parts 511, 521, 531 protruding downwards (towards the LED units 40) from the metal plate 400 at a state where the respective tubular parts are fitted into the respective through-holes 430, 440 from the upper side. In other words, the core holding member 500 has four protrusion parts 511, 521, 531 in a line in the front-rear direction.

A lower end (distal end) of the most forward protrusion part 511 is configured so that it is positioned at a lower side than a lower end (distal end) of the conduction part 411 of the metal plate 400 (refer to FIG. 8). Thereby, it is possible to prevent a user's finger from contacting with the lower end of the conduction part 411 and thus being hurt by the protrusion part 511.

Also, the most forward protrusion part 511 protrudes more downwards than the other protrusion parts 521, 531. That is, a protruding amount of the most forward protrusion part 511 from the metal plate 400 is larger than those of the protrusion parts 521, 531 from the metal plate 400.

As described above, the protruding amount of the most forward protrusion part 511, to which a user's finger is most likely to come close, is set to be larger. Thereby, since a height of the conduction part 411 corresponding to the protrusion part 511 can be made high, it is possible to further suppress the static electricity from being transferred from the user's finger towards the flexible flat cables C. Also, the protruding amounts of the other protrusion parts 521, 531 are made to be smaller, so that it is possible to reduce the weight of the core holding member 500, and thereby reduce the weight of the color printer 1.

Also, as shown in FIG. 7, the three tubular parts 510, 520 of the front side are provided with a pair of holding claws 512, 522, which are an example of the holding part for holding the ferrite cores FC. Since, the tubular parts 510, 520 are provided with the holding claws 512, 522, it is possible to easily attach the ferrite cores FC compared to when the ferrite cores are attached to the tubular parts by using a tape and the like.

Specifically, the pair of holding claws 512, 522 has a pair of arm parts 512A, 522A extending upwards from insides of the tubular parts 510, 520 and claw parts 512B, 522B protruding inwards from distal ends of the respective arm parts 512A, 522A in the left-right direction. The respective arm parts 512A, 522A are configured to be allowed to deflection deform in the left-right direction, so that the ferrite cores FC can be detachably attached to the holding claws 512, 522.

Accordingly, since the ferrite cores FC are detachably attached to the holding claws 512, 522, it is possible to reuse the core holding member 500 or the ferrite cores FC.

The invention is not limited to the above-described illustrative embodiment and can also be implemented in a variety of embodiments that are exemplified as follows.

In the above-described illustrative embodiment, the conduction part 411 is provided to only the most forward through-hole 430 of the four through-holes 430, 440. However, the invention is not limited thereto. For example, a plurality of conduction parts may be provided.

In the above-described illustrative embodiment, the conduction part 411 is integrally formed with the metal plate 400. However, the invention is not limited thereto. For example, the conduction part may be configured by a metal member different from the metal plate.

In the above-described illustrative embodiment, the top cover 11 has been exemplified as the cover. However, the invention is not limited thereto. For example, the cover may also be a front cover and the like.

In the above-described illustrative embodiment, the LED unit 40 has been exemplified as the exposure member. However, the invention is not limited thereto. For example, the exposure member may include one light emitting device such as LED and fluorescent lamp, and a plurality of liquid crystals in a line in the left-right direction or an optical shutter of a PLZT device at an outer side of the light emitting device.

In the above-described illustrative embodiment, the flexible flat cable C has been exemplified as the cable. However, the invention is not limited thereto. Any cable may be used.

In the above-described illustrative embodiment, the exposure members, the through-holes and the protrusion parts are provided in plural. However, the invention is not limited thereto. For example, the exposure member and the like may be singularly provided in a monochrome printer and the like.

In the above-described illustrative embodiment, the pair of holding claws 512, 522 has been exemplified as the holding part. However, the invention is not limited thereto. For example, a plurality of engaging protrusions that engages with an outer periphery of the ferrite core may be also used.

In the above-described illustrative embodiment, the invention is applied to the color printer 1. However, the invention is not limited thereto. For example, the invention may be also applied to the other image forming apparatuses such as copier and complex machine.

The invention provides illustrative, non-limiting examples as follows:

(1) In a first aspect, there is provided an image forming apparatus including: a body frame including an opening; a cover configured to rotate between an open position where the cover opens the opening and a closed position where the cover closes the opening and including a base end portion rotatably supported by the body frame, and further including a distal end portion opposite to the base end portion; an exposure member including a light source, supported by the cover and configured to swing relative to the cover when the cover is rotated from the closed position to the open position; a cable configured to transmit current to the exposure member; and a metal plate fixed to the cover and having a through-hole through which the cable extends, the metal plate including, a main body part, and a conduction part protruding, toward the exposure member, from the main body part adjacent to the through-hole at the distal end side of the cover.

According to the above-described configuration, upon opening of the cover, even when the exposure member swings relative to the cover and the cable is thus exposed towards the distal end portion side (user side) through a gap between the exposure member and the metal plate, it is possible to suppress the static electricity from being transferred from a user's finger towards the cable by the conduction part that is provided at a distal end portion side of the through-hole, i.e., at a position closer to a user than the cable passing through the through-hole.

(2) In a second aspect, there is provided the image forming apparatus according to the first aspect, wherein the conduction part is integrally formed with the main body part.

According to the above-described configuration, it is possible to simplify the structure compared to when the conduction part is provided as a separate member from the main body part.

(3) In a third aspect, there is provided the image forming apparatus according to the first or second aspect, further including a tubular resin member that is fitted into the through-hole of the metal plate and into which the cable is inserted, wherein the resin member includes a protrusion part protruding from the metal plate side towards the exposure member side, and wherein a distal end of the protrusion part is closer to the exposure member than a distal end of the conduction part.

According to the above-described configuration, it is possible to suppress the cable from contacting the metal plate by the resin member. Further, it is possible to prevent a user from contacting the distal end of the conduction part by the protrusion part.

(4) In a fourth aspect, there is provided the image forming apparatus according to the third aspect, further including a tubular noise reduction member that surrounds the cable and is configured to reduce noise generated from the cable, wherein the resin member includes a holding part configured to hold the noise reduction member.

According to the above-described configuration, it is possible to more easily attach the noise reduction member to the resin member, compared to when the noise reduction member is attached to the resin member by using a tape and the like.

(5) In a fifth aspect, there is provided the image forming apparatus according to the fourth aspect, wherein the noise reduction member is detachably attached to the holding part.

According to the above-described configuration, it is possible to reuse the resin member and the noise reduction member.

(6) In a sixth aspect, there is provided the image forming apparatus according to any one of the third to fifth aspects, wherein a plurality of exposure members, a plurality of through-holes and a plurality of protrusion parts are respectively provided side by side from the distal end portion side of the cover towards the base end portion side of the cover, wherein the conduction part is provided to at least the through-hole of the plurality of through-holes, which is located at the most distal end portion side, and wherein the protrusion part of the plurality of protrusion parts, which is located at the most distal end portion side, protrudes more towards the exposure member than the other protrusion parts.

According to the above-described configuration, a protruding amount of the protrusion part at the distal end portion side, to which a user's finger is most likely to come close, is set to be larger. Thereby, since a height of the conduction part corresponding to the protrusion part can be made high, it is possible to further suppress the static electricity from being transferred from the user's finger towards the cable. Also, protruding amounts of the other protrusion parts are made to be smaller, so that it is possible reduce the weight of the resin member, thereby reducing the weight of the image forming apparatus.

(7) In a seventh aspect, there is provided the image forming apparatus according to the sixth aspect, wherein the conduction part is provided to only the through-hole which is located at the most distal end portion side.

According to the above-described configuration, since the conduction part is provided to only the through-hole at the most distal end portion-side, to which a user's finger is most likely to come close, it is possible to reduce the weight of the metal plate, thereby reducing the weight of the image forming apparatus, compared to when the conduction part is provided to all of the through-holes.

(8) In an eighth aspect, there is provided the image forming apparatus according to any one of the first to seventh aspects, wherein the cover is a top cover that is arranged at an upper portion of the body frame and an upper surface thereof is provided with a discharge tray having an inclined bottom surface, and wherein a base end portion of the exposure member arranged below the inclined bottom surface has an inclined surface that is opposed to the inclined bottom surface when the cover is at the closed position.

According to the above-described configuration, since it is possible to bring the base end portion of the exposure member close to the bottom surface of the discharge tray, it is possible to reduce the size of the image forming apparatus in an upper-lower direction.

(9) In a ninth aspect, there is provided an image forming apparatus including: a body frame including an opening; a cover configured to move between an open position where the cover opens the opening and a closed position where the cover closes the opening, the cover including a first end portion supported by the body frame and a second end portion opposite to the first end portion; an exposure member including a first end portion supported by the cover and a second end portion opposite to the first end portion of the exposure member, a distance between the second end portion of the exposure member and the cover being larger when the cover is in the closed position than when the cover is in the open position; a metal plate fixed to the cover and including a through-hole having a first end portion and a second end portion, a distance between the first end portion of the through-hole and the first end portion of the cover being smaller than a distance between the second end portion of the through-hole and the first end portion of the cover; a cable passing through the through hole and configured to transmit current to the exposure member; and a conduction part provided to the metal plate at the second end portion of the through-hole and extending towards the exposure member side.

(10) In a tenth aspect, there is provided the image forming apparatus according to the ninth aspect, wherein the conduction part is provided to the metal plate at only the second end portion of the through-hole.

(11) In an eleventh aspect, there is provided the image forming apparatus according to the ninth aspect, wherein a gap between the exposure member and the metal plate is larger when the cover is in the open position than when the cover is in the closed position.

(12) In a twelfth aspect, there is provided the image forming apparatus according to the ninth aspect, wherein the conduction part is integrally formed with the metal plate.

What is claimed is:

1. An image forming apparatus comprising:

a body frame including an opening;

a cover configured to rotate between an open position where the cover opens the opening and a closed position where the cover closes the opening, the cover including a base end portion rotatably supported by the body frame, and a distal end portion opposite to the base end portion;

an exposure member including a light source, the exposure member being supported by the cover and configured to swing relative to the cover when the cover is rotated from the closed position to the open position;

a cable configured to transmit current to the exposure member; and a metal plate fixed to the cover and including:

a main body part having a through-hole through which the cable extends; and a conduction part protruding, toward the exposure member from a portion of the main body part, the portion of the main body part being located adjacent to the through-hole and at a distal end side of the through-hole.

2. The image forming apparatus according to claim 1, wherein the conduction part is integrally formed with the main body part.

3. The image forming apparatus according to claim 1, further comprising a tubular resin member that is fitted into the through-hole of the metal plate and into which the cable is inserted, wherein the resin member includes a protrusion part protruding from a metal plate side towards an exposure member side, and wherein a distal end of the protrusion part is closer to the exposure member than a distal end of the conduction part.

4. The image forming apparatus according to claim 3, further comprising a tubular noise reduction member that surrounds the cable and is configured to reduce noise generated from the cable, wherein the resin member includes a holding part configured to hold the noise reduction member.

5. The image forming apparatus according to claim 4, wherein the noise reduction member is detachably attached to the holding part.

6. The image forming apparatus according to claim 3, wherein a plurality of exposure members, a plurality of through-holes and a plurality of protrusion parts are respectively provided side by side from a distal end portion side of the cover towards a base end portion side of the cover, wherein the conduction part is provided to at least the through-hole of the plurality of through-holes, which is located at a most distal end portion side, and wherein the protrusion part of the plurality of protrusion parts, which is located at the most distal end portion side, protrudes more towards the exposure member than the other protrusion parts.

7. The image forming apparatus according to claim 6, wherein the conduction part is provided to only the through-hole which is located at the most distal end portion side.

8. The image forming apparatus according to claim 1, wherein the cover is a top cover that is arranged at an upper portion of the body frame and an upper surface thereof is provided with a discharge tray having an inclined bottom surface, and wherein a base end portion of the exposure member arranged below the inclined bottom surface has an inclined surface that is opposed to the inclined bottom surface when the cover is at the closed position.

9. An image forming apparatus comprising:

a body frame including an opening;

a cover configured to move between an open position which opens the opening and a closed position which closes the opening, the cover including a first end portion supported by the body frame and a second end portion opposite to the first end portion;

an exposure member including a first end portion supported by the cover and a second end portion opposite to the first end portion of the exposure member, a distance between the second end portion of the exposure member and the cover being larger when the cover is in the closed position than when the cover is in the open position;

a metal plate supported by the cover and including a through-hole having a first edge portion and a second edge portion, a distance between the first end edge portion of the through-hole and the first end portion of the cover being smaller than a distance between the second edge portion of the through-hole and the first end portion of the cover;

a cable passing through the through hole and configured to transmit current to the exposure member; and a conduction part provided to the metal plate at the second edge portion of the through-hole and extending towards an exposure member side from the second edge portion of the through-hole.

10. The image forming apparatus according to claim 9, wherein the conduction part is provided to the metal plate at only the second edge portion of the through-hole.

11. The image forming apparatus according to claim 9, wherein a gap between the exposure member and the metal plate is larger when the cover is in the open position than when the cover is in the closed position.

12. The image forming apparatus according to claim 9, wherein the conduction part is integrally formed with the metal plate.

13. An image forming apparatus comprising:

a body frame including an opening;

a cover configured to rotate between an open position where the cover opens the opening and a closed position where the cover closes the opening and including a base end portion rotatably supported by the body frame, and further including a distal end portion opposite to the base end portion;

an exposure member including a light source, supported by the cover and configured to swing relative to the cover when the cover is rotated from the closed position to the open position;

a cable configured to transmit current to the exposure member;

a metal plate fixed to the cover and having a through-hole through which the cable extends, the metal plate including:

a main body part; and a conduction part protruding, toward the exposure member, from the main body part adjacent to the through-hole at a distal end portion side of the cover; and a tubular resin member that is fitted into the through-hole of the metal plate and into which the cable is inserted.

14. The image forming apparatus according to claim 13, wherein the conducting part is integrally formed with the main body part.

15. The image forming apparatus according to claim 13, wherein the resin member includes a protrusion part protruding from a metal plate side towards an exposure member side, and wherein a distal end of the protrusion part is closer to the exposure member than a distal end of the conduction part.

16. The image forming apparatus according to claim 15, further comprising a tubular noise reduction member that surrounds the cable and is configured to reduce noise generated from the cable, wherein the resin member includes a holding part configured to hold the noise reduction member.

17. The image forming apparatus according to claim 16, wherein the noise reduction member is detachably attached to the holding part.

18. The image forming apparatus according to claim 15, wherein a plurality of exposure members, a plurality of through-holes and a plurality of protrusion parts are respectively provided side by side from a distal end portion side of the cover towards a base end portion side of the cover, wherein the conducting part is provided to at least the through-hole of the plurality of through-holes, which is located at a most distal end portion side, and wherein the protrusion part of the plurality of protrusion parts, which is located at the most distal end portion side, protrudes more towards the exposure member than the other protrusion parts.

19. The image forming apparatus according to claim 18, wherein the conduction part is provided to only the through-hole which is located at the most distal end portion side.

20. The image forming apparatus according to claim 13, wherein the cover is a top cover that is arranged at an upper portion of the body frame and an upper surface thereof is provided with a discharge tray having an inclined bottom surface, and wherein a base end portion of the exposure member arranged below the inclined bottom surface has an inclined surface that is opposed to the inclined bottom surface when the cover is at the closed position.

* * * * *